US005819351A

United States Patent [19]

Porper

[11] Patent Number: 5,819,351

[45] Date of Patent: Oct. 13, 1998

[54] BALL CLEANING AND WAXING MACHINE

[76] Inventor: Joseph Porper, 9142 Jordan Ave. Chatsworth, Los Angeles, Calif. 91304

[21] Appl. No.: 888,816

[22] Filed: Jul. 7, 1997

[51] Int. Cl.[6] ..... A63B 47/04

[52] U.S. Cl. ..... 15/21.2; 15/88.1; 15/97.1

[58] Field of Search ..... 15/3.1, 3.12–3.16, 15/21.2, 88.1, 97.1

[56] References Cited

U.S. PATENT DOCUMENTS

| | | | |
|---|---|---|---|
| 1,730,973 | 10/1929 | Henrizi | 15/21.2 |
| 1,792,211 | 2/1931 | Brewer | 15/21.2 |
| 4,370,772 | 2/1983 | Gustafsson | 15/97.1 |
| 5,546,629 | 8/1996 | Shim | 15/21.2 X |

FOREIGN PATENT DOCUMENTS

| | | | |
|---|---|---|---|
| 4122059 | 1/1993 | Germany | 15/21.2 |
| 4117 | of 1883 | United Kingdom | 15/21.2 |
| 1434637 | 5/1976 | United Kingdom | 15/21.2 |

*Primary Examiner*—Mark Spisich
*Attorney, Agent, or Firm*—Gilbert Kivenson

[57] ABSTRACT

A cleaning and waxing machine for billiard balls utilizing a horizontal,rotating disk. A plurality of circular apertures in the disk holds the balls. Rotation of the disk causes a constantly varying spin to be imparted to the billiard balls and also makes them contact stationary carpeting layers mounted above and below as they spin. As detergent,water and wax are successively added to the balls, they will be efficiently cleaned, uniformly waxed and polished to a bright finish.

3 Claims, 2 Drawing Sheets

BALL CLEANING AND WAXING MACHINE

INTRODUCTION AND BACKGROUND OF THE INVENTION

The present invention relates to a cleaning and waxing machine for billiard balls. Although the accumulation of dirt and dust on the polished surface of a billiard ball is slow, it does occur especially in the presence of oily materials accidentally spilled on playing surfaces, the handling of the balls by players, dusty atmospheres, etc. This accumulation decreases the accuracy of impact and rebound shots on which the enjoyment of billiard games depend. Presently used devices, known as ball polishers, use a rapidly revolving, carpet-covered disk which is contained in a pan. Polishing wax is added to the billiard balls. Ball spin, induced by the motion of the disk is along one spin axis so that neither the wax application nor the polishing action is uniform. if an even layer of wax is desired, as is the case in tournaments, e.g., the balls are often waxed and polished by hand.

The present apparatus provides ball spin along a multitude of axes so that application of detergent, wax and polishing is uniform.

GENERAL DESCRIPTION OF THE INVENTION

Fast speeds (900 rpm and up) are used in prior art machines in an attempt to obtain a high polish. The liquid wax is applied to the balls and they are placed on a moving, carpet-covered disk. The high speeds of the disk make the wax move to the disk edge and fly off. In the present invention, two stationary layers of carpeting (an upper and a lower) are employed and the balls are rotated by a turning mechanism against the upper and lower layers to produce a scrubbing, rinsing and waxing action. The present method of turning the balls induces an independent rotation of each ball and a constantly changing spin axis. This results in each portion of each ball coming in contact with the cleaning surfaces. Moderate speeds (60–80 rpm) are sufficient for effective cleaning and waxing of the balls.

DETAILED DESCRIPTION OF THE INVENTION

Figure 1:
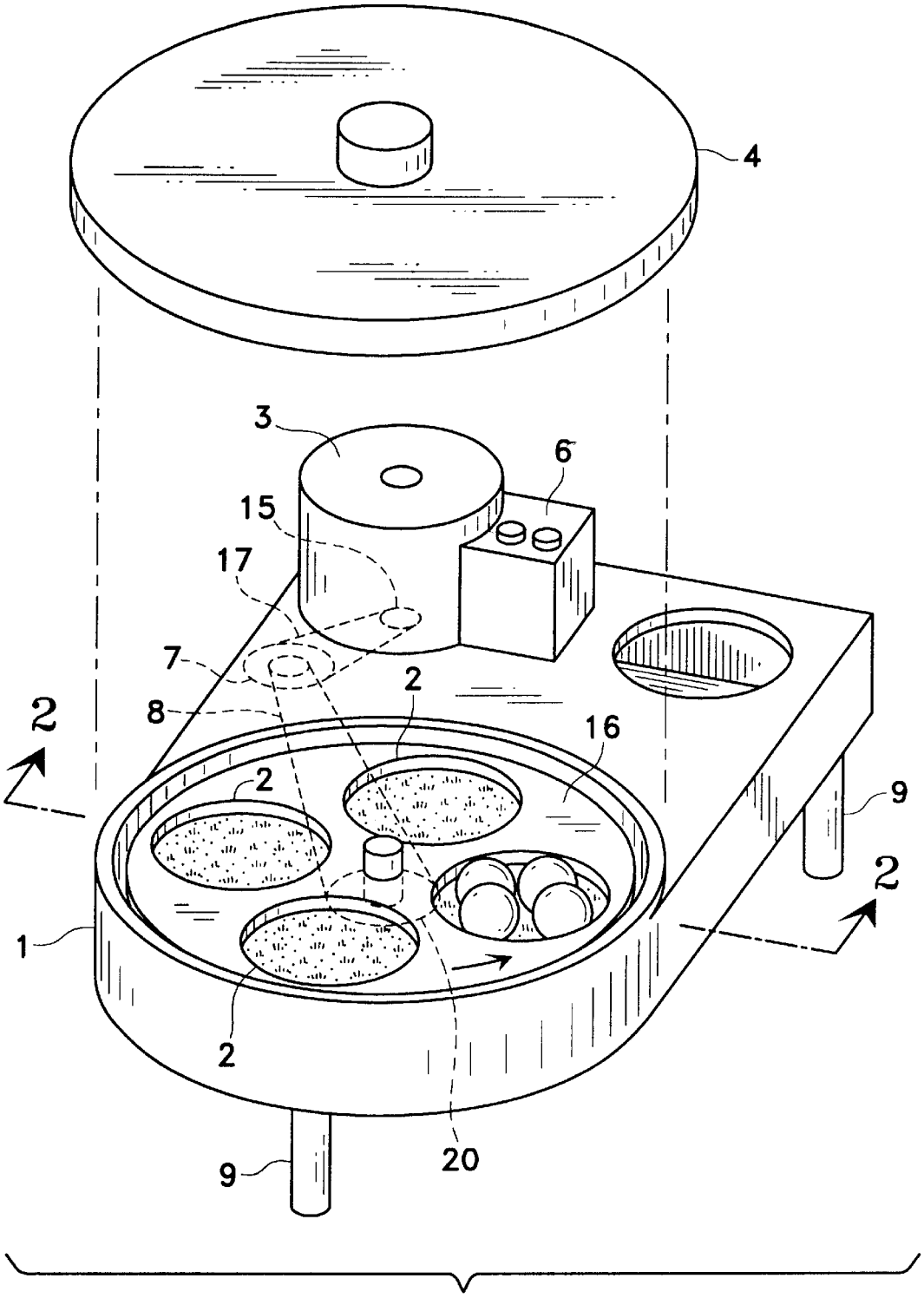
FIG. 1 is an isometric view of a preferred embodiment of the cleaning and waxing machine showing the master disk with driving apertures, tripod stand, drive motor and cover.
Figure 2:
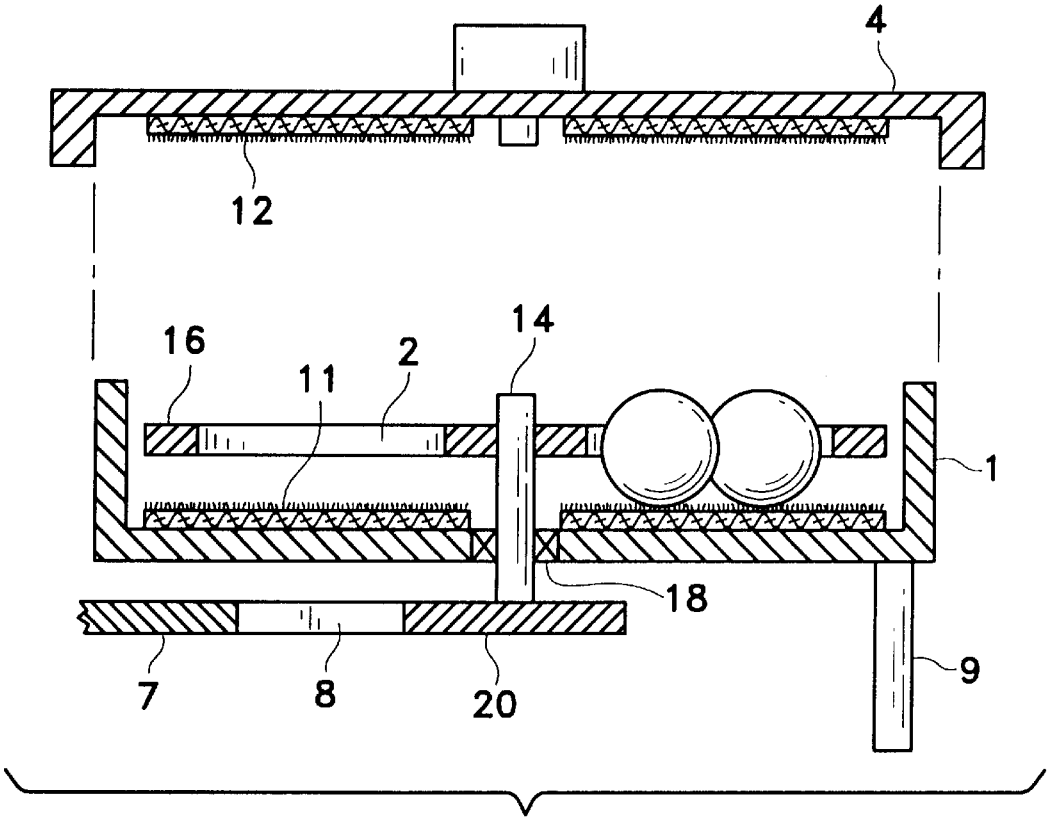
FIG. 2 is a cross section of FIG.1 taken along lines—2—2—showing the polishing surface and the driving mechanism.
Figure 3:
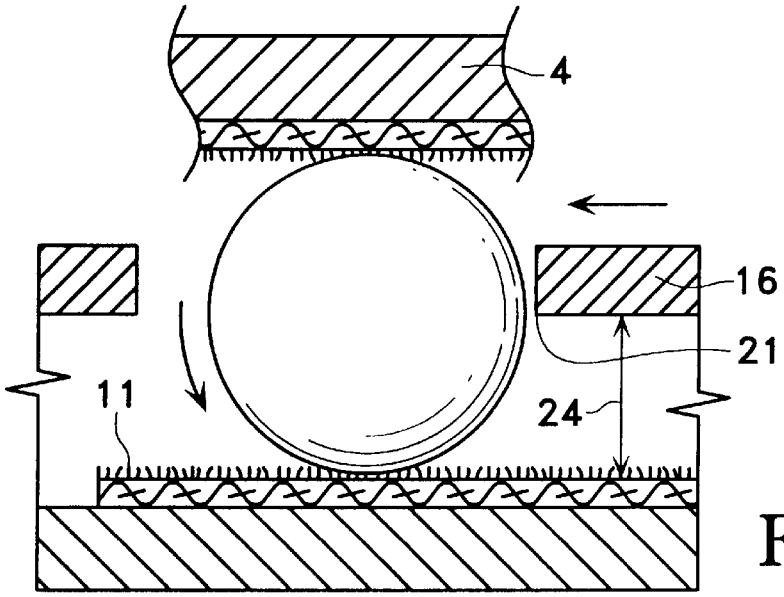
FIG. 3 is an enlarged, partial view of FIG. 2 showing how spin is imparted to each ball as the aperture is rotated.

The present ball cleaner and waxer will be described with reference to FIGS. 1, 2 and 3. The washer and polisher machine, is housed in the casing 1 which contains the master disk 16. The latter is mounted on the shaft 14 (FIG. 2). Bearing 18 supports the shaft which is driven by pulley 20, belt 8 and the idler pulley 7. The latter is connected through a second belt 17 to the motor pulley 15. Disk 16 is thus driven at reduced speed by motor 3. Disk speed can be additionally adjusted by the use of the controller 6. A stationary layer of carpeting 11 is fastened to the bottom of the casing 1. A second layer of carpeting 12 is fastened to the bottom of lid 4 which is used to cover the machine. A plurality of apertures 2 are cut into the disk. These apertures have a diameter approximately four times that of an individual ball so that four balls fit loosely in each aperture as shown in FIG. 1. The distance 24 above the carpeting of the disk (FIG. 3) is such that the motion of the aperture edge 21 imparts a rolling motion to each ball it contacts. The contact point is continually changing as the aperture turns and this alters the spin axis of each ball. The entire area of each ball is thus made to contact both the upper layer and the lower layer of the carpeting.

The balls are manually and successively wetted with detergent, rinse water and then liquid wax to complete each cycle of washing, rinsing and polishing the balls.

The casing 1 is mounted on the three, equally spaced legs 9 to form a tripod. The machine can thus be placed on any flat surface without the possibility of rocking and increased transmission of vibration while in operation.

A number of other embodiments are possible without departing from the concept of this invention. It would be possible for example, to use a bevel gear drive between the motor and the rim of disk 16 instead of the pulley-belt arrangement described. It would also be practical to feed detergent, rinse and wax automatically and to drain the casing through solenoid-operated valves to make up a timed cycle. In another embodiment, the components would be sized to handle golf balls instead of billiard balls.

What is claimed is as follows:

1. A machine for cleaning and polishing balls comprising:

a) a rotatable disk containing a plurality of circular apertures, each of said apertures of a size to hold a number of balls;

b) a container having an open top and a partially sealed bottom, said disk being mounted within said container such that it is spaced from and substantially parallel to the bottom of the container, the bottom being lined with a first layer of carpeting;

c) a removable lid for closing the open top of said container, the underside of said lid being lined with a second layer of carpeting;

d) a controllable drive means for turning the disk at various speeds;

e) tripod means for supporting the container on a flat surface and f) whereby rotation of the disk causes an edge of each of the apertures to come in contact with the respective number of balls therein, and moving them into rubbing contact with the first and second carpeting layers to bring about a cleansing action when detergent and rinse are added to the container and a polishing action when liquid wax is added to said container.

2. A machine for cleaning and polishing balls as described in claim 1 in which said controllable drive means is a pulley system containing an idler and an electric motor with a speed control.

3. A machine for cleaning and polishing balls as described in claim 1 in which said tripod means are three legs fixed equidistantly on the bottom of said container, the bottom of said legs geometrically defining a plane so that the machine when set on any approximately flat surface will not generate excess vibration even if the legs are of slightly different lengths.

* * * * *